United States Patent [19]

Igarashi et al.

[11] Patent Number: 5,038,633

[45] Date of Patent: Aug. 13, 1991

[54] TRANSMISSION FOR MINI SHOVEL CAR

[75] Inventors: Takashi Igarashi; Takahisa Murakami, both of Ehime, Japan

[73] Assignee: Kabushiki Kaisha Kobe Seiko Sho, Kobe, Japan

[21] Appl. No.: 555,634

[22] Filed: Jul. 23, 1990

[30] Foreign Application Priority Data

Sep. 28, 1989 [JP] Japan ..... 1-252794
Sep. 28, 1989 [JP] Japan ..... 1-252795
Sep. 28, 1989 [JP] Japan ..... 1-252796

[51] Int. Cl.[5] ..... F16H 37/06

[52] U.S. Cl. ..... 74/664; 74/331; 74/724; 180/6.2; 180/6.38; 180/6.7

[58] Field of Search ..... 74/664, 665 R, 665 B, 74/665 E, 724, 331; 180/6.2, 6.38, 6.7

[56] References Cited

U.S. PATENT DOCUMENTS 2,999,553 9/1961 Schwartz ..... 180/6.7
3,678,786 7/1972 Szekely ..... 74/724 X
3,766,790 10/1973 Weir ..... 74/665 E X
3,922,930 12/1975 Fletcher et al. ..... 74/665 B
3,999,444 12/1976 Willman ..... 74/724 X
4,016,779 4/1977 von Greyerz ..... 74/724
4,085,697 4/1978 Gaasenbeek ..... 180/6.2 X
4,274,302 6/1981 Herscovici ..... 74/661
4,286,479 9/1981 Baumann et al. ..... 74/664 X
4,756,207 7/1988 Bianchi et al. ..... 74/664

FOREIGN PATENT DOCUMENTS 1087041 2/1955 France .
642205 3/1948 United Kingdom .

*Primary Examiner*—Allan D. Herrmann
*Assistant Examiner*—William O. Trousdell
*Attorney, Agent, or Firm*—Oblon, Spivak, McClelland, Maier & Neustadt

[57] ABSTRACT

A transmission of compact construction particularly suitable for use on a crawler mini shovel car having a boom mounted on a front portion of the vehicle body and an engine and a transmission mounted on rear portions of the vehicle body. The transmission includes an input shaft disposed within a transmission case in a longitudinal direction of the vehicle FR (forward-reverse) transmission shafts rotatably provided on the opposite sides of the input shaft in parallel relation therewith and coupled with the input shaft through gears, a worm gear provided at an end portion of each FR transmission shaft, and a worm wheel meshed with the corresponding one of the worm gears on the FR transmission shafts and mounted on each of worm wheel shafts coupled with left and right crawler drive shafts through reducing gears.

3 Claims, 7 Drawing Sheets

TRANSMISSION FOR MINI SHOVEL CAR

BACKGROUND OF THE INVENTION

1. Field of the Invention

This invention relates to a transmission for a mini shovel car, and more particularly to a worm gear mechanism for a transmission of the type which is designed to drive the left and right crawler drive shafts separately.

2. Description of the Related Art

There have existed no mini shovel cars which are capable of performing excavating operations in a narrow space. In manufacturing a mini shovel car of this sort, considerations need to be given to lower the center of gravity in order to reduce the vehicle body size. A boom which supports a working attachment is mounted on a front portion of the vehicle body while the engine and transmission are mounted on rear portions for balancing the weights in the front and rear portions of the vehicle.

As a means for reducing the body size of such a mini shovel car, it is also conceivable to cut the size of the transmission case. However, the transmissions which are mounted on ordinary conventional shovel cars usually need a large case to accommodate therein complicated mechanisms such as forward/reverse switch mechanism and independent left and right brake mechanisms for driving the left and right crawlers independently to facilitate spin turns of the vehicle.

SUMMARY OF THE INVENTION

It is therefore an object of the present invention to solve the technical problems which are encountered in developing a mini shovel car with a compact body, more specifically, to provide a transmission of a simplified compact construction suitable for use on a mini shovel car.

In accordance with the present invention, there is provided a transmission for a crawler type small-size working vehicle having a boom mounted on a front portion of the vehicle body and an engine and a transmission mounted on rear portions of the vehicle body, the transmission comprising: an input shaft disposed within a transmission case in a longitudinal direction of the vehicle; FR (forward-reverse) transmission shafts rotatably provided on the opposite sides of the input shaft in parallel relation therewith and coupled with the input shaft through gears; a worm gear provided at an end portion of each FR transmission shaft; and a worm wheel meshed with the corresponding one of the worm gears on the FR transmission shafts and mounted on each of worm wheel shafts coupled with left and right crawler drive shafts through reducing gears.

According to the invention, the engine power is transmitted to the input shaft to rotate the FR transmission shafts on the opposite sides of the input shaft through gears, and the worm wheel through the worms which are mounted on end portions of the respective FR transmission shafts. The rotation of each worm wheel is transmitted to a corresponding crawler drive shaft through reducing gears.

Since the rotation of the input shaft is transmitted to each crawler drive shaft through a worm and worm wheel coupling which prevents reverse rotation, spin turns of the vehicle can be made by transmitting the power only one of the left and right crawler drive shafts. The rotation of the worm wheel is reduced through reducing gears before driving the crawler drive shaft, so that a large reduction ratio can be obtained from a worm wheel of a small diameter. It follows that an greater space can be secured between the worm wheel and the ground surface.

According to another aspect of the invention, there is provided a transmission for a crawler type small-size working vehicle having a boom mounted on a front portion of the vehicle body and an engine and a transmission mounted on rear portions of the vehicle body, the transmission including: an input shaft disposed within a transmission case in a longitudinal direction of the vehicle; a sleeve freely rotatably fitted on the input shaft and integrally supporting thereon first and second gears; a pair of FR transmission shafts journalled on the opposite sides of the input shaft in parallel relation therewith; an auxiliary transmission shaft journalled between the FR transmission shafts; third and fourth gears mounted on each of the FR transmission shafts, the third gear being constantly meshed with the first gear and the fourth gear being spaced from the second gear by a predetermined gap, the second gear being constantly meshed with a drive gear mounted on an end portion of the auxiliary transmission shaft.

In this arrangement, the engine power is transmitted firstly from the input shaft to the auxiliary transmission shaft through auxiliary transmission gears and then from a drive gear at the end of the auxiliary transmission shaft to the second and fourth gears. Together with the first gear, the second gear is provided on a cylindrical sleeve which is freely rotatable about the input shaft irrespective of the rotation of the latter. The rotation of the first gear is transmitted to the third gear on each FR transmission shaft. The rotation of either the third or fourth gear is selectively connected to or disconnected from each FR transmission shaft through a clutch to drive the crawler in the forward or reverse direction.

In this transmission of simplified construction, the power of forward or reverse rotation can be transmitted to the respective FR transmission shafts without using a counter shaft and counter gears.

According to still another aspect of the invention, there is provided a transmission for a crawler type small-size working vehicle having a boom mounted on a front portion of the vehicle body and an engine and a transmission mounted on rear portions of the vehicle body, the transmission including: an input shaft disposed within a transmission case in a longitudinal direction of the vehicle; a sleeve freely rotatably fitted on the input shaft and integrally supporting thereon first and second gears; a pair of FR transmission shafts journalled on the opposite sides of the input shaft in parallel relation therewith; an auxiliary transmission shaft journalled between the FR transmission shafts; third and fourth gears freely rotatably mounted on each of the FR transmission shafts, the third gear being constantly meshed with the first gear and the fourth gear being set apart from the second gear by a predetermined gap space; a drive gear mounted on an end portion of the auxiliary transmission shaft and constantly meshed with the second and fourth gears; a clutch provided between the third and fourth gears to selectively connect or disconnect the rotation of either the third or fourth gear to the corresponding FR transmission shaft; a worm mounted on an end portion of each FR transmission shaft; a worm wheel mounted on each of a pair of transverse worm wheel shafts extending perpendicularly to the respective FR transmission shafts and meshed with the corresponding worm; and reducing gears mounted on the worm wheel shafts and left and right crawler drive shafts of the vehicle and meshed with each other to connect the FR transmission shafts to the corresponding one of the crawler drive shafts.

In this arrangement, the speed of the engine power is reduced as it is transmitted from the input shaft to the auxiliary transmission shaft, and then transmitted from the drive gear to the second and fourth gears of the transmission. Along with the first gear, the second gear is provided on a cylindrical sleeve which is freely rotatable about the input shaft irrespective of the rotation of the latter. On the other hand, the fourth gear is freely rotatable about the FR transmission shaft. Rotation is transmitted from the first to third gear which is also freely rotatable about the FR transmission shaft. Therefore, the third and fourth gears are rotated in opposite directions, and either the third or fourth gear is selectively connected to the FR transmission shaft by a clutch to transmit thereto rotation of forward or reverse direction.

By the worm and worm wheel coupling, the speed of rotation is reduced and the direction of the axis of power transmission is changed to transmit the power to the respective crawler drive shaft through reducing gears.

The above and other objects features and advantages of the invention will become apparent from the following description and the appended claims, taken in conjunction with the accompanying drawings which show by way of example a preferred embodiment of the invention.

DESCRIPTION OF PREFERRED EMBODIMENTS

Figure 1:
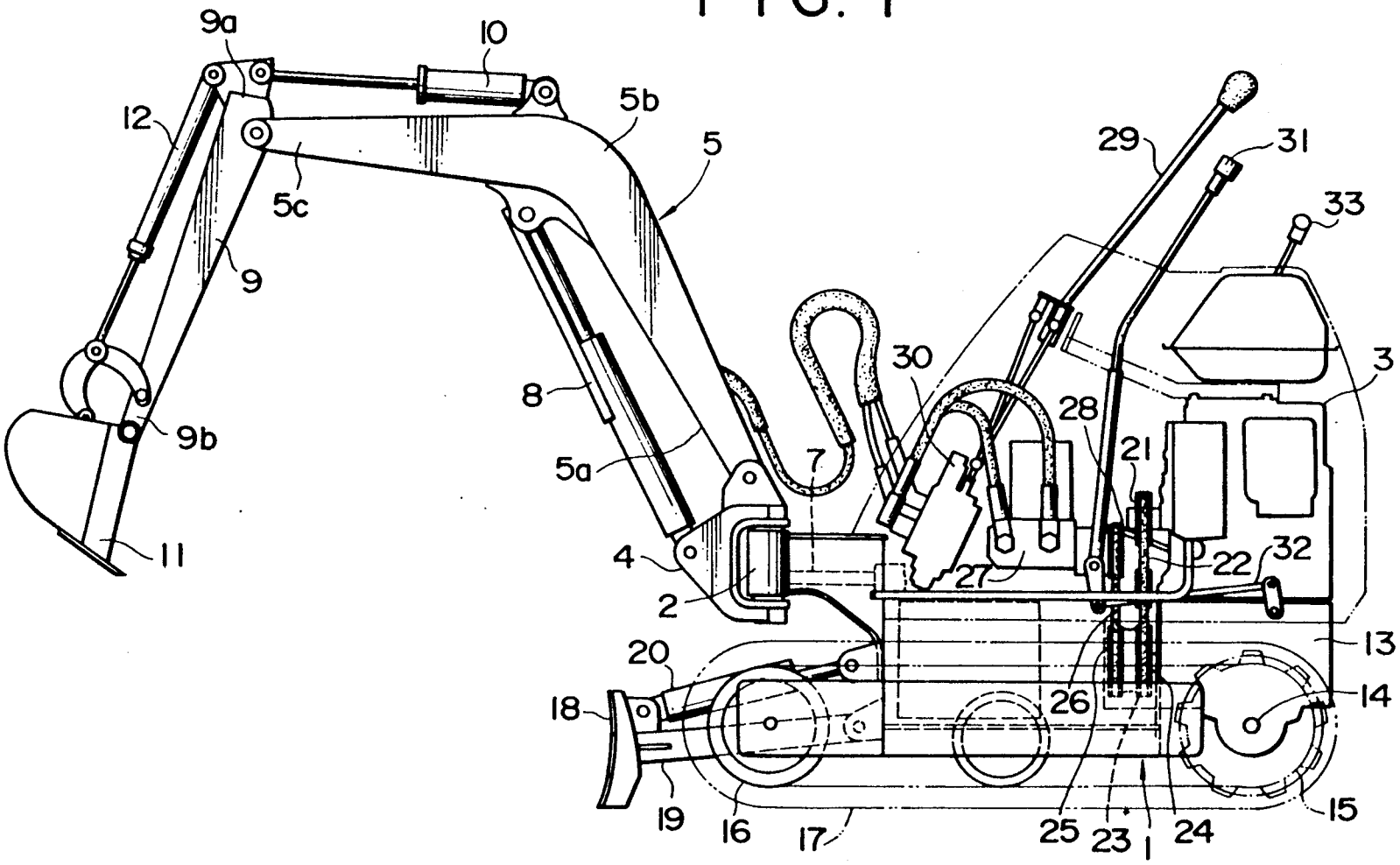
FIG. 1 is a partly cutaway side view of a mini shovel car embodying the present invention.

Hereafter, the invention is described more particularly by way of a preferred embodiment shown in the drawings.

Figure 2:
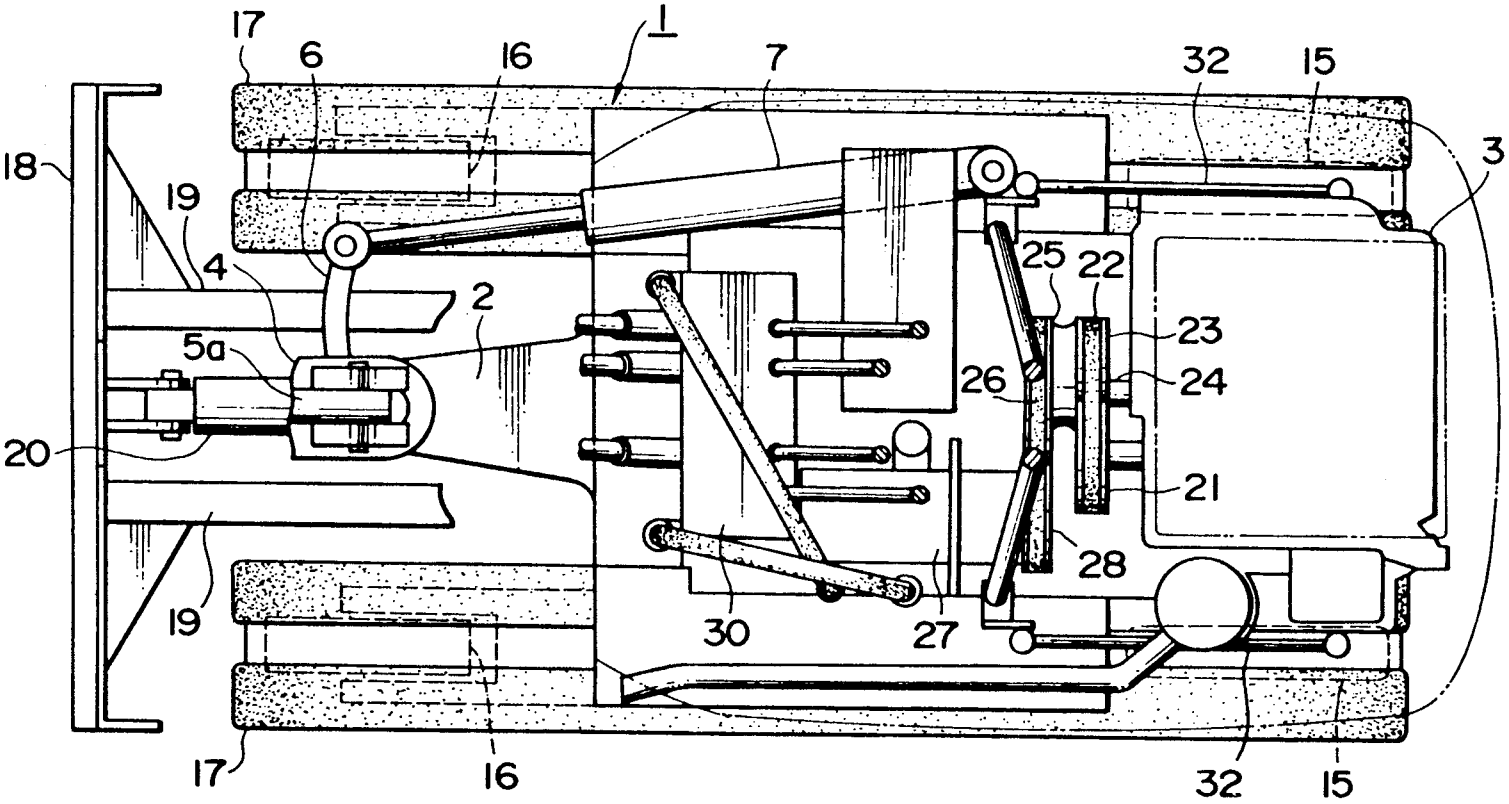
FIG. 2 is a partly cutaway plan view of the shovel car of FIG. 1.
Figure 3:
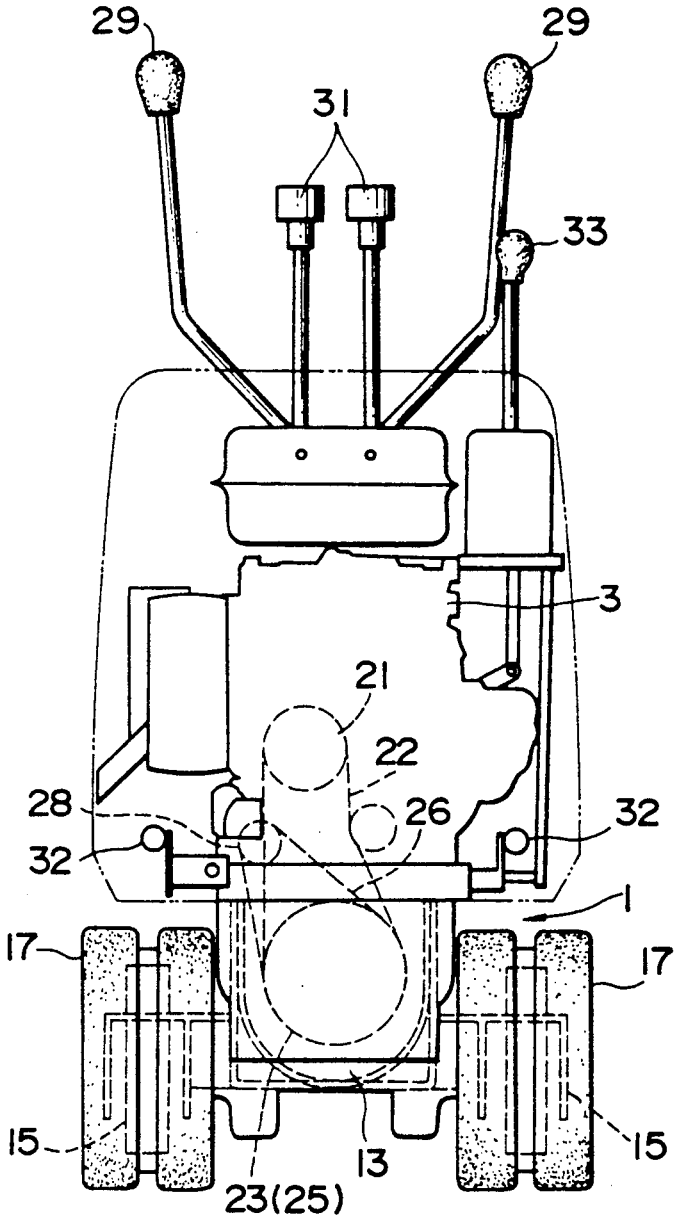
FIG. 3 is a schematic back view of the same shovel car.

Referring first to FIGS. 1 through 3, there is shown a mini shovel car employing a transmission according to the present invention. The shovel car is provided with a boom mount portion 2 in a front portion of its body frame 1, and an engine 3 is mounted in a rear portion of the frame 1. Base portion 5*a* of a boom 5 is swingably supported by a swing bracket 4 which is attached to the boom mount portion 2. Projected from one side of the swing bracket 4 is an arm bracket 6 which is pivotally connected to the fore end of a swing cylinder 7 such that the boom 5 is turned to the left and right upon expanding and shrinking the swing cylinder 7. The boom 5 is pivotable up and down about the base portion 5*a* by operation of a boom cylinder 8 which is connected between the swing bracket 4 and an intermediate portion 5*b* of the boom 5. An arm 9 which has its base end 9*a* pivotally connected to a fore end portion 5*c* of the boom 5 is pivotable up and down by operation of an arm cylinder 10 which is connected between the intermediate portion 5*b* of the boom 5 and the pivotally connected base end 9*a* of the arm 9. Further, a bucket 11 which is pivotally supported at the fore end 9*b* of the arm 9 is pivotable up and down by operation of a bucket cylinder 12.

Fixedly mounted beneath the engine 3 is a transmission case 13 which has drive shafts 14 projected to the outside through the opposite lateral sides thereof. A drive sprocket 15 is provided at the outer end of each drive shaft 14. Crawlers 17 are passed between and fitted around the drive sprockets 15 and driven wheels 16 which are mounted at the opposite sides of the frame 1 in a lower front portion thereof. Arms 19 of a soil pusher blade 18 are pivotally supported between the driven wheels 16 to move the blade 18 up and down by means of a hydraulic cylinder 20.

The power of the engine 3 is transmitted to a transmission pulley 23 through a belt 22 which is passed around the transmission pulley 23 and an engine pulley 21, thereby to rotate the input shaft 24 of the transmission. The transmission pulley 23 is in the form of a double pulley having a belt 26 passed around a coaxial pulley 26 to transmit power to a pulley 28 of a hydraulic pump 27. The reference numeral 29 denotes a manual operating lever which is connected to a control valve 30 for operating the boom 5, bucket 11 and the like, and the reference numeral 31 denotes vehicle drive control levers for switching the operation to forward or reverse drive. The left and right drive control levers 31 are extended onto the left and right side walls of the transmission case and linked to a shifter which will be described hereinlater. Designated at 33 is an auxiliary shift lever.

Figure 4:
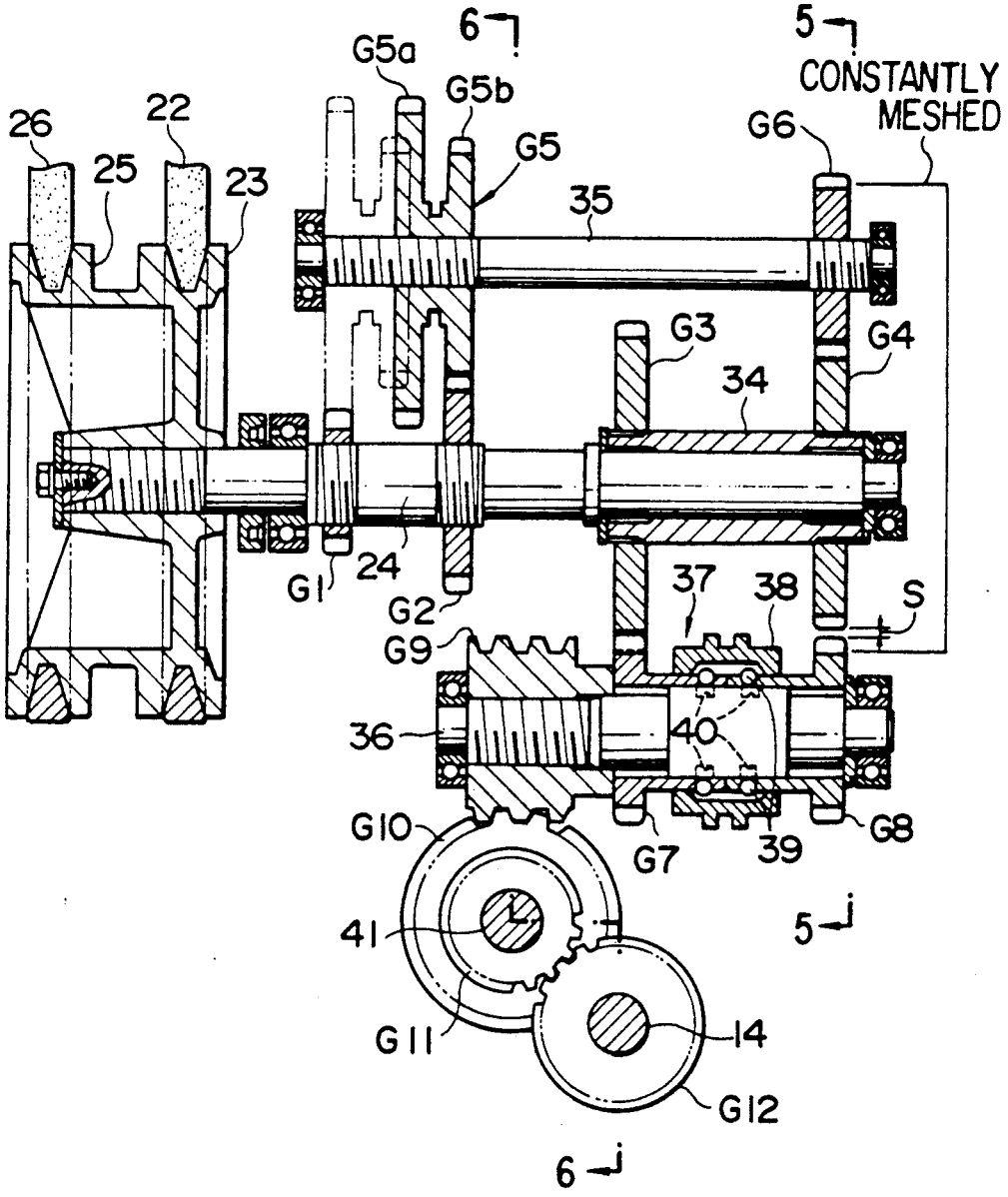
FIG. 4 is a development explanatory of the paths of power transmission through various coupled shafts and gears in the transmission case.
Figure 5:
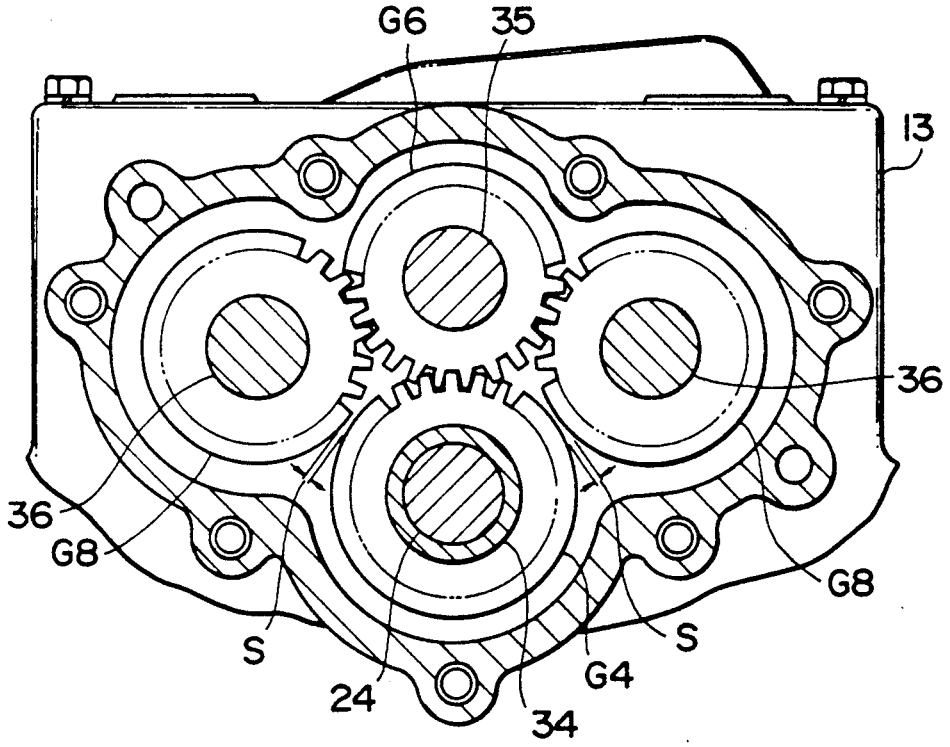
FIG. 5 is a vertically sectioned back view of the transmission case, taken on line 5—5 of FIG. 4.
Figure 6:
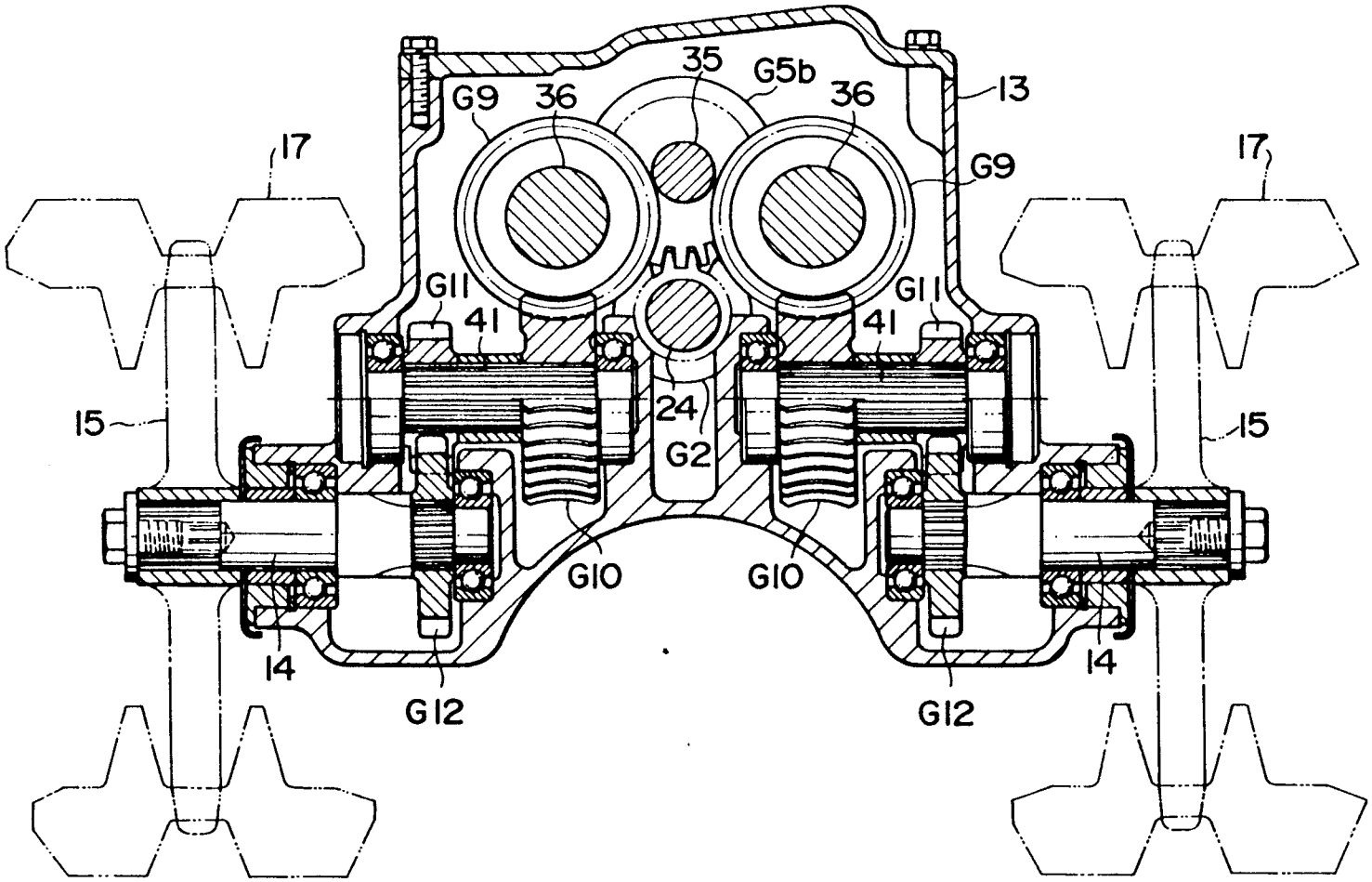
FIG. 6 is a vertically sectioned back view of the transmission case, taken on line 6—6 of FIG. 4.

Referring to FIG. 4 for explanation of the internal construction of the transmission, there is shown a development of various shafts and gears which are in meshed state. Reference is also had to FIGS. 5 and 6 which show the actual positions of various shafts. As mentioned hereinbefore, the input shaft 24 is disposed within the transmission case 13 longitudinally of the vehicle frame. A transmission pulley 23 is fixedly fitted on the fore end of the input shaft 24 which is projected forward of the transmission case 13. A gear G1 of small diameter and a gear G2 of large diameter are mounted in spaced relation on an intermediate portion of the input shaft 24, and a cylindrical sleeve 34 is freely rotatably fitted on a rear portion of the input shaft 24. First and second gears G3 and G4 are fixedly mounted on fore and rear end portions of the sleeve 34, respectively. Namely, the first and second gears G3 and G4 are freely rotatable in synchronism with each other about the axis of the input shaft 24.

As shown particularly in FIGS. 4 and 6, an auxiliary transmission shaft 35 is journalled above the input shaft 24 in parallel relation with the latter. An auxiliary transmission gear G5 is slidably fitted on a fore portion of the auxiliary transmission shaft 35 for sliding movements in forward and rearward directions. The auxiliary transmission gear G5 is integrally provided with a large diameter gear G5*a* and a small diameter gear G5*b*. The large diameter gear G5*a* is meshed with the small diameter gear G1 on the input shaft 24 when the auxiliary gear G5 is slid forward along the auxiliary transmission shaft 35, while the small diameter gear G5*b* is meshed with the large diameter gear G2 on the input shaft 24 when the auxiliary gear G5 is slid rearward along the auxiliary shaft 35. This auxiliary gear G5 is slidably moved by a shifter (not shown) which is connected to the auxiliary shift lever 33. A drive gear G6 which meshes with the second gear G4 on the input shaft 24 is fitted on the rear end of the auxiliary transmission shaft 35 to transmit the rotation of the input shaft 24 from the drive gear G6 to the second gear G4 after speed reduction by the auxiliary transmission gear G5.

As shown in FIGS. 4 and 5, FR transmission shafts 36 are journalled on the opposite sides of the input shaft 24 in parallel relation with the latter. Third and fourth gears G7 and G8 are mounted on each FR transmission shaft 36, the third gear G7 being constantly meshed with the first gear G3. On the other hand, a predetermined gap space S is provided between the fourth gear G8 and the second gear G4 which is constantly meshed with the drive gear G6 on the auxiliary transmission shaft 35. A ball clutch 37 is provided between the third and fourth gears G7 and G8, including a slider 38 which is movable backward or forward to push steel balls 39 into holes 40 for transmission of rotation. Namely, upon operating the afore-mentioned vehicle drive lever 31, the shifter (not shown) is moved forward or backward through the link 32 to slide the slider 38 forward or backward, thereby connecting the rotation of either the third or fourth gear G7 or G8 to the FR transmission shaft 36 to switch the direction of rotation of the latter.

As seen in FIG. 4 and 5, a worm gear G9 is mounted at the fore end of each of the left and right FR transmission shafts 36, the worm gear G9 being meshed with a worm wheel G10 which is fitted on the inner end of the corresponding one of worm wheel shafts 41 which are journalled transversely of the transmission case 13. Reducing gears G11 which are fitted on the outer ends of the worm wheel shafts 41 are meshed with reducing gears G12 on the inner ends of the drive shafts 14 which are journalled beneath the worm wheel shafts 41, respectively. Further, the outer ends of the drive shafts 14 are projected out of the transmission case 13 through the opposite lateral side walls thereof. Crawlers 17 are fitted around drive sprockets 15 which are mounted on the projected portions of the drive shafts 14.

Figure 7:
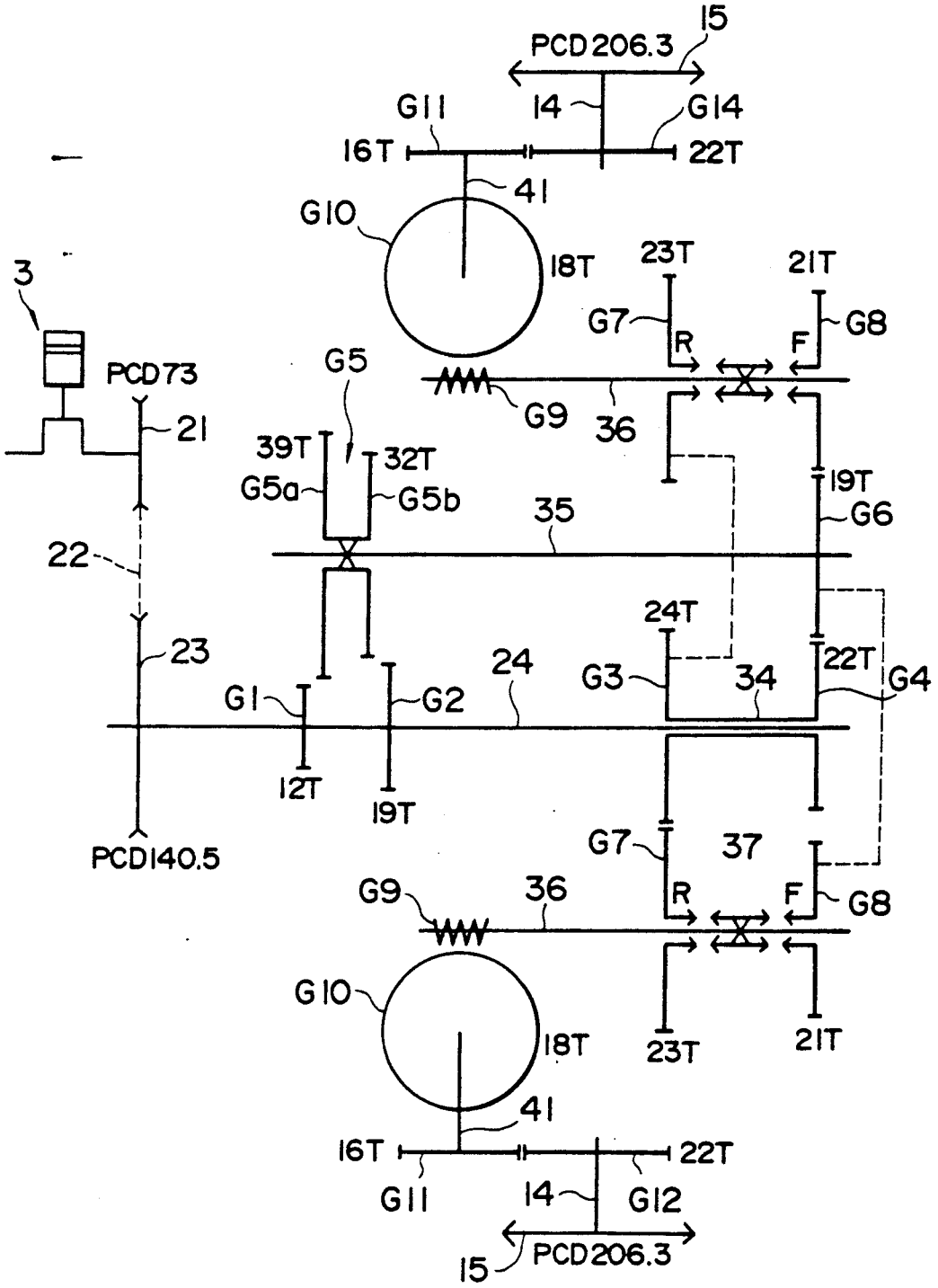
FIG. 7 is a skeletal view of the various shafts and gears in meshed state, which constitute the major components of the transmission of this embodiment.

FIG. 7 is a skeletal view of the various shafts and gears in meshed state, which constitute the major components of the transmission of this embodiment. In this figure, the reference T denotes the number of teeth of the gear, and the reference PCD denotes the pitch circle diameter of the pulley. The rotation of the engine 3 is transmitted to the input shaft 24 by the belt 22 which is passed around the engine pulley 21 and the transmission pulley 23. Upon externally operating the auxiliary shift lever 33, the auxiliary shift gear G5 is slid in the backward or forward direction on and along the auxiliary transmission shaft 35 to bring the auxiliary shift gear G5 into meshing engagement with either the small diameter gear G1 or large diameter gear G2 on the input shaft 24. For example, a speed ratio of 12/39 ($\approx$0.30) is established when the auxiliary shift gear G5*a* of large diameter is meshed with the small diameter gear G1, and a ratio of 19/32 ($\approx$0.59) of slightly higher speed is established when the auxiliary shift gear G5*b* of small diameter is meshed with the large diameter gear G2. The following description explains the transmission which is in the low speed position where the auxiliary shift gear G5 is in the forwardly slid position.

As described hereinbefore, the rotation of the auxiliary transmission shaft 35, which is at a reduced speed, is transmitted to the second gear G4 which is freely rotatable about the input shaft 24, and also to the fourth gears G8 which are freely rotatable about the respective FR transmission shafts 36. The speed ratio of the drive gear G6 to the fourth gear G8 is 19/21, while the speed ratio of the drive gear G6 to the second gear G4 is 19/22. The first and second gears G3 and G4 which are provided integrally with the cylindrical sleeve 34 are rotated at uniform speed, and the third gear G7 which is meshed with the second gear G3 is rotated in a direction inverse to the rotation of the fourth gear G8. The speed ratio of the first gear G3 to the third gear G7 is 24/23.

Thus, the third gear G7 is rotated at a speed ratio of $12/39\times19/22\times24/23\approx0.28$ to the speed of the input shaft 24 and in a direction inverse to the rotation of the latter. On the other hand, the fourth gear G8 is rotated at a speed ratio of $12/39\times19/21\approx0.28$ in the same direction as the input shaft 24. Accordingly, as the fourth gear G8 is connected to the FR transmission shaft 36 by the ball clutch 37, the FR transmission shaft 36 is rotated in the forward direction to drive the crawler in the forward direction, and, conversely when the third gear G7 is connected to the FR transmission shaft 36, the latter is turned in the reverse direction to drive the crawler in the reverse direction. Besides, since the third and fourth gears G7 and G8 are rotated at the same speed ratio as described hereinbefore, the FR transmission shaft 36 is rotated at the same speed no matter whether the clutch 37 is connected to the forward or reverse gear, equalizing the speeds in the forward and reverse positions.

The worm G9 on each FR transmission shaft 36 is provided with a couple of threads to rotate the worm wheel G10 at a speed ratio of 2/18. Further, through the reducing gears G11 and G12 which are mounted on the worm wheel shaft 41 and crawler drive shaft 14, respectively, the speed of the crawler drive shaft 14 is eventually reduced to a speed ratio of $0.28\times2/18\times16/22=0.02$ compared to the speed of the input shaft 24.

Thus, the use of the worm G9 and worm wheel G10 and the transmission of rotation through the reducing gears G11 and G12 permits one to obtain a large reduction ratio in spite of the small worm wheel diameter. Therefore, it becomes possible to enhance the mechanical strength of the worm wheels G10 while securing an ample space between the center portion of the transmission and the ground surface. Further, the combination of the worm G9 and worm wheel G10 has a function of preventing reverse rotation, blocking rotation from the side of the crawler drive shaft 14 without using a brake mechanism.

Needless to say, various modifications or alterations can be added to the above-described preferred embodiment of the invention without departing from the spirit and scope of the invention, and therefore it is to be understood that the invention includes all such modifications and alterations as long as encompassed by the appended claims.

As clear from the foregoing particular description of a preferred embodiment, the transmission of the invention is arranged to transmit the rotation of the input shaft firstly to the auxiliary transmission shaft and then from the drive gear to the second and fourth gears. The fourth gear is rotated in the same direction as the input shaft, while through the first and second gears the third gear is rotated in a direction reverse to the rotation of the input shaft. Accordingly, either forward or reverse rotation can be selectively obtained without using a counter shaft and counter gears, permitting to provide a transmission of simplified construction consisting of a reduced number of component parts.

Further, the combination of the worm and worm gear which has a function of preventing reverse rotation permits spin turns of the vehicle without use of a brake mechanism. A large reduction ratio can be obtained by the use of worm wheels of small diameter since the rotation of the worm wheel is transmitted to a crawler drive shaft through reducing gears. The use of worm wheels of small diameter contributes to provide a greater space between the center portion of the transmission case and the ground surface as mentioned hereinbefore to permit the vehicle to avoid obstacles which may exist on the ground or to accommodate arms of a step or steps under the transmission case.

Thus, the transmission of the present invention has various advantages including the improved braking force and improved durability and reduction in size of the worm wheels, in addition to the simplified construction and reductions in size of the transmission and shovel car.

What is claimed is:

1. A transmission for a crawler-mounted small-size working vehicle of the type having a boom mounted on a front portion of the vehicle body and an engine and a transmission mounted on rear portions of the vehicle body, said transmission comprising:

an input shaft disposed within a transmission case in a longitudinal direction of said vehicle;

two FR (forward-reverse) transmission shafts respectively rotatably provided on opposite sides of said input shaft and in parallel relation therewith, said FR transmission shafts being coupled with said input shaft via coupling gears;

a worm gear provided at an end portion of each of said FR transmission shafts;

a worm wheel meshed with a corresponding one of said worm gears on each of said FR transmission shafts, said worm wheels each being mounted on a worm wheel shaft; and reducing gears coupling each of said worm wheel shafts with left and right crawler drive shafts.

2. A transmission for a crawler-mounted small-size working vehicle having a boom mounted on a front portion of the vehicle body and an engine and a transmission mounted on rear portions of the vehicle body, the transmission comprising:

an input shaft disposed within a transmission case in a longitudinal direction of the vehicle;

a sleeve freely rotatably fitted on said input shaft and integrally supporting thereon first and second gears;

two FR transmission shafts respectively journalled on opposite sides of said input shaft in parallel relation therewith;

an auxiliary transmission shaft journalled between said FR transmission shafts;

third and fourth gears mounted on each of said FR transmission shafts, said third gear being constantly meshed with said first gear and said fourth gear being spaced from the second gear by a predetermined gap, said second gear being constantly meshed with a drive gear mounted on an end portion of said auxiliary transmission shaft.

3. A transmission for a crawler-mounted small-size working vehicle having a boom mounted on a front portion of the vehicle body and an engine and a transmission mounted on rear portions of the vehicle body, the transmission comprising:

an input shaft disposed within a transmission case in a longitudinal direction of the vehicle;

a sleeve freely rotatably fitted on said input shaft and integrally supporting thereon first and second gears;

a pair of FR transmission shafts respectively journalled on opposite sides of said input shaft and in parallel relation therewith;

an auxiliary transmission shaft journalled between said FR transmission shafts;

third and fourth gears freely rotatably mounted on each of said FR transmission shafts, said third gear being constantly meshed with said first gear, and said fourth gear being set apart from said second gear by a predetermined gap space;

a drive gear mounted on an end portion of said auxiliary transmission shaft and constantly meshed with said second and fourth gears;

a clutch provided between said third and fourth gears to selectively connect or disconnect the rotation of a selected one of said third and fourth gears to the corresponding FR transmission shaft;

a worm mounted on an end portion of each FR transmission shaft;

a worm wheel mounted on each of a pair of transverse worm wheel shafts extending perpendicularly to the respective FR transmission shafts and meshed with a corresponding worm; and reducing gears mounted on said worm wheel shafts and left and right crawler drive shafts of the vehicle and meshed with each other to connect said FR transmission shafts to the corresponding one of the crawler drive shafts.

* * * * *